US011001346B2

(12) United States Patent
Barwick

(10) Patent No.: US 11,001,346 B2
(45) Date of Patent: May 11, 2021

(54) ATTACHABLE WATERCRAFT CHAIR

(71) Applicant: Ronald H. Barwick, Oxford, FL (US)

(72) Inventor: Ronald H. Barwick, Oxford, FL (US)

( * ) Notice: Subject to any disclaimer, the term of this patent is extended or adjusted under 35 U.S.C. 154(b) by 29 days.

(21) Appl. No.: 16/601,707

(22) Filed: Oct. 15, 2019

(65) Prior Publication Data

US 2020/0047855 A1 Feb. 13, 2020

Related U.S. Application Data

(63) Continuation-in-part of application No. 15/951,383, filed on Apr. 12, 2018, now Pat. No. 10,479,454.

(60) Provisional application No. 62/546,319, filed on Aug. 16, 2017.

(51) Int. Cl.
*B63B 29/04* (2006.01)
*A47D 1/10* (2006.01)

(52) U.S. Cl.
CPC ..... *B63B 29/04* (2013.01); *A47D 1/10* (2013.01); *B63B 2029/043* (2013.01); *B63B 2221/00* (2013.01)

(58) Field of Classification Search
CPC ... B63B 29/04; B63B 2029/043; B63B 29/06; A47D 1/10
See application file for complete search history.

(56) References Cited

U.S. PATENT DOCUMENTS

| | | | | |
|---|---|---|---|---|
| 2,446,036 | A | 7/1948 | Vit et al. | |
| 4,719,653 | A * | 1/1988 | Bishop | A47D 1/10 297/28 |
| 5,157,797 | A * | 10/1992 | Forwick | A61G 7/1003 4/566.1 |
| 6,435,126 | B1 | 8/2002 | Burke | |
| 6,827,396 | B1 * | 12/2004 | Jewell | A47C 7/002 297/16.1 |
| 7,475,652 | B2 * | 1/2009 | Dvorak | B63B 27/146 114/362 |
| 7,832,804 | B2 | 11/2010 | LaFreniere | |
| 7,900,575 | B2 | 3/2011 | Walbridge et al. | |
| 8,028,641 | B1 | 10/2011 | Sly | |
| 8,479,664 | B2 | 7/2013 | Nelson | |
| 8,783,765 | B1 * | 7/2014 | Matus | A47D 1/10 297/152 |
| 8,801,099 | B2 * | 8/2014 | Ebel | B63B 29/06 297/277 |
| 9,199,696 | B1 | 12/2015 | Bonell | |
| 10,568,465 | B2 * | 2/2020 | Fusco | A47K 3/127 |

* cited by examiner

*Primary Examiner* — Andrew Polay
(74) *Attorney, Agent, or Firm* — Boudwin Intellectual Property; Daniel Boudwin

(57) ABSTRACT

An attachable watercraft chair. The attachable watercraft chair includes a chair formed by a back member and a seat member that are pivotally connected. The back member has a first end placed distally to the seat member and a second end placed proximally to the seat member. A first pair of brackets are connected to the back member. The first pair of brackets have suction cups mounted on them. Also, a second pair of brackets are connected to the back member. The second pair of brackets have a support bar that spans across the back member. The attachable watercraft chair can be attached and removed from a watercraft.

18 Claims, 3 Drawing Sheets

ATTACHABLE WATERCRAFT CHAIR

CROSS REFERENCE TO RELATED APPLICATIONS

This application claims the benefit of U.S. Non-Provisional application Ser. No. 15/951,383 filed on Apr. 12, 2018, which claims the benefit of U.S. Provisional Application No. 62/546,319 filed on Aug. 16, 2017. The above identified patent application is herein incorporated by reference in its entirety to provide continuity of disclosure.

BACKGROUND OF THE INVENTION

The present invention relates to an attachable watercraft chair. Many people enjoy going on watercraft with their family and friends. When people go on watercraft, they may want to enter the water to swim or to cool off. When a person enters the open water, however, they may wish to rest on stable surface. Usually, this means that the person must climb out of the water onto the watercraft in order to sit or rest on a stable surface. Alternatively, flotation devices may be utilized in recreational aquatic activities. These devices, however, are unstable by nature and can drift in currents. This would require the individual to swim back to the watercraft, which can be dangerous if the individual is tired.

Constantly getting in and out of the water can be frustrating and inconvenient, as pulling oneself out of water requires physical exertion. Additionally, it can be uncomfortable to emerge from the water, as a person can be cold when they emerge. Re-entering can also be inconvenient, particularly when the individual has already taken time to adjust to the temperature of the water. As such, there is a defined need in the known art for a device that will allow an individual to rest in the water while engaging in recreational aquatic activities.

SUMMARY OF THE INVENTION

In view of the foregoing disadvantages inherent in the known types of recreational aquatic furniture devices now present in the prior art, the present invention provides an attachable watercraft chair wherein the same can be utilized for providing convenience for the user when being engaged upon a side wall of a watercraft.

The present system comprises a chair. The chair is formed by a back member that pivotally attached to a seat member. The back member defines a first end that is disposed oppositely a second end. The first end is distally disposed to the seat member and the second end is proximally disposed to the seat member. A first pair of brackets are disposed on the back member. The first pair of brackets include a pair of suction cups disposed thereon. Additionally, a second pair of brackets are disposed on the back member between the first pair of brackets and the second end of the back member. The second pair of brackets include a support bar that spans across the back member.

In another embodiment of the present invention, it is an object to provide a pair of arm members, such that an individual resting on the attachable watercraft chair may rest his or her arms.

In a further embodiment of the present invention, it is an object to provide an extension arm between the first pair of brackets and the pair of suction cups, thus allowing for additional space between the back member and a side wall of a watercraft.

In yet another embodiment of the present invention, it is an object to provide a pair of suction cups that are lever-actuated. As such, the suction force of the pair of suction cups is increased.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
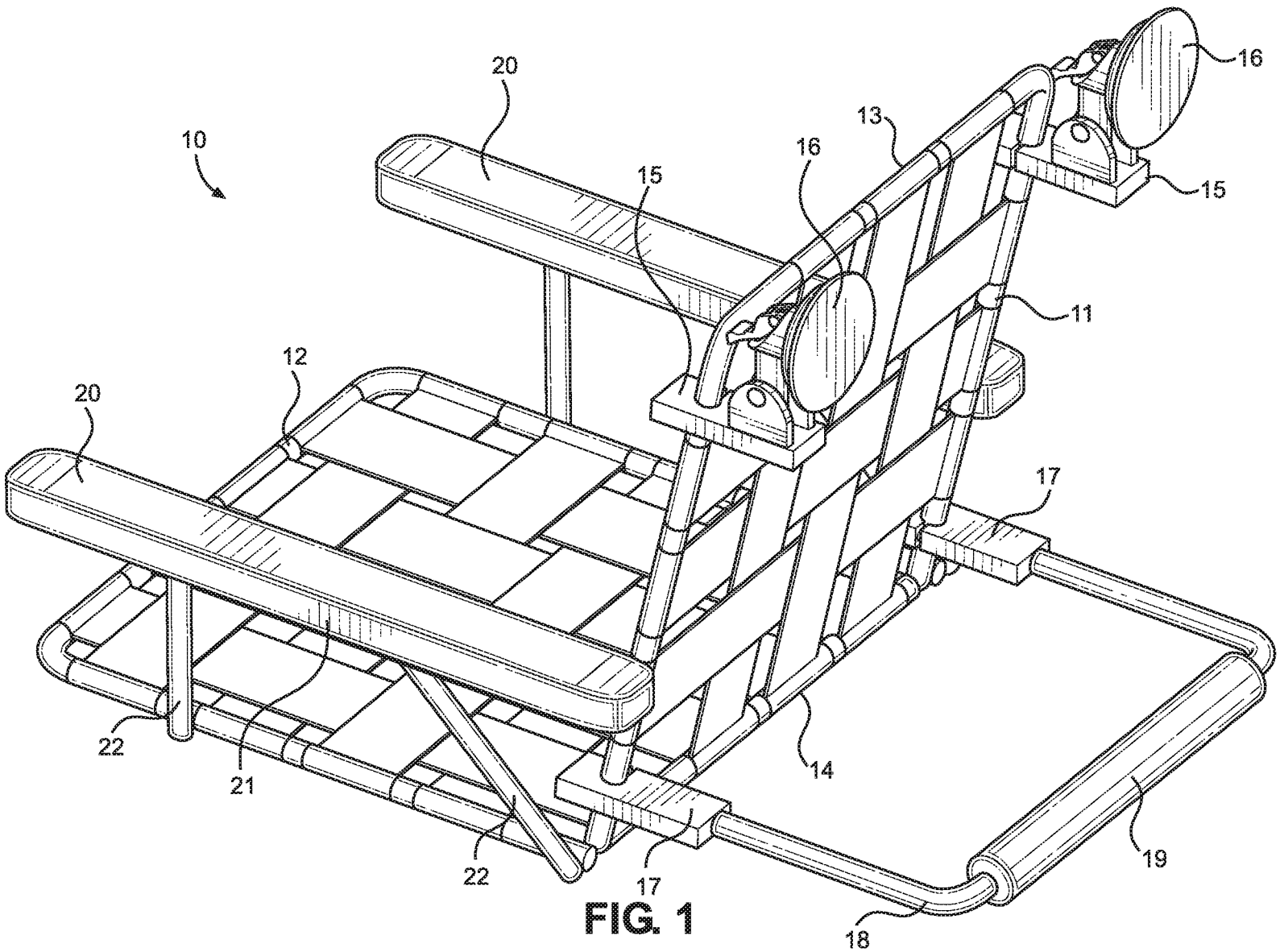
FIG. 1 shows a perspective view of an embodiment of the attachable watercraft chair.

Reference is made herein to the attached drawings. Like reference numerals are used throughout the drawings to depict like or similar elements of the attachable watercraft chair. The figures are intended for representative purposes only and should not be considered to be limiting in any respect.

Referring now to FIG. 1, there is shown a perspective view of an embodiment of the attachable watercraft chair. The attachable watercraft chair 10 comprises a chair. The chair includes a back member 11. The back member 11 is pivotally affixed to a seat member 12. As such, when an individual engages the attachable watercraft chair 10, their back will rest on the back member 11 and their rear will rest on the seat member 12. The back member 11 includes a first end 13 disposed oppositely a second end 14. The seat member 12 is specifically positioned, such that the seat member 12 is pivotally attached to the second end 14 of the back member 11.

A first pair of brackets 15 are disposed on the back member 11. Specifically, the first pair of brackets 15 are disposed on the back member 11 proximal to the first end 13 of the back member 11, As such, the first pair of brackets 15 are disposed near the top of the back member 11. In the illustrated embodiment, the first pair of brackets 15 comprises a pair of suction cups 16. The pair of suction cups 16 is configured to engage a side of a watercraft via suction. The pair of suction cups 16 is of any suitable configuration for securing the attachable watercraft chair 10 to the side of a watercraft.

A second pair of brackets 17 are disposed on the back member 11. Specifically, the second pair of brackets 17 are disposed on the back member 11 proximal to the second end 14 of the back member 11. As such, the second pair of brackets 17 are disposed near the bottom of the back member 11. In the illustrated embodiment, the second pair of brackets 17 comprises a support bar 18 extending across the back member 11. The support bar 18 is configured to rest upon a side of a watercraft. In the shown embodiment, the support bar 18 is a U-shaped bar that extends outward from the back member 11 and transverses the back member 11 at a distance beyond the back member 11 opposite the seat member 12. The support bar 18 is rigid in construction, such that it can support the weight of a person in the attachable watercraft chair 10. In the illustrated embodiment, the support bar 18 comprises a pad 19 disposed thereon. The pad 19 is configured to reduce the amount of force exerted upon the side of the watercraft by the attachable watercraft chair 10. In other embodiments, an additional pair of suction cups may be disposed thereon. As such, two pairs of suction cups may be provided to add additional strength and flexibility to the attachable watercraft chair 10.

In the illustrated embodiment, the attachable watercraft chair 10 further comprises a pair of arm members 20. The pair of arm members 20 are rotatably engaged with the back member 11 and the seat member 12. In the illustrated embodiment, each arm member of the pair of arm members 20 comprises an arm receiver 21, which is disposed parallel to the seat member 12 and is pivotally attached to the back member 11. The arm receiver 21 is attached to the seat member 12 via a pair of arm receiver supports 22. The pair of arm members 20 are configured to add support to the arms of the user when the user is seated in the attachable watercraft chair 10.

Figure 2:
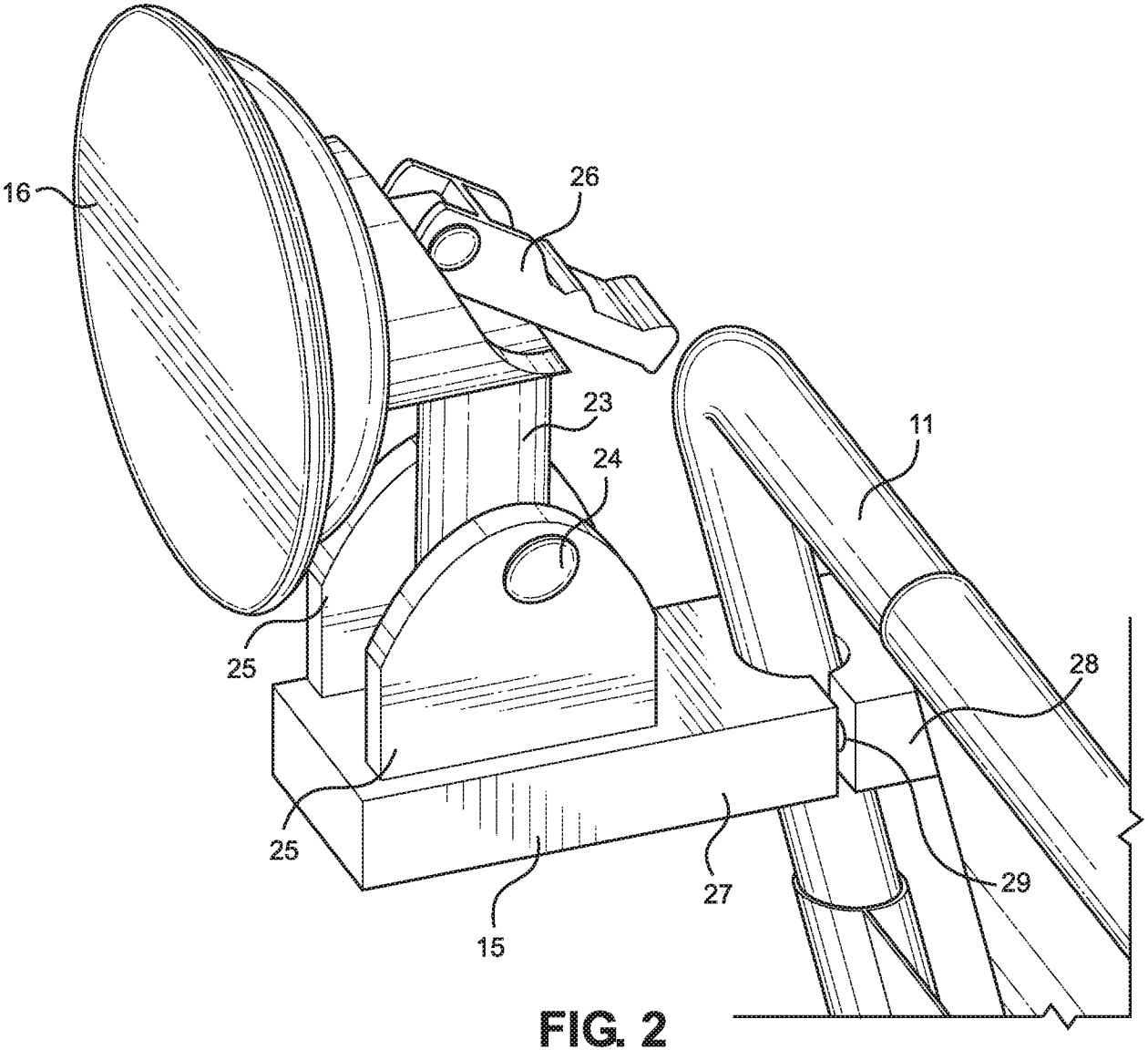
FIG. 2 shows a close-up view of a suction cup of an embodiment of the attachable watercraft chair.

Referring now to FIG. 2, there is shown a close-up view of a suction cup of an embodiment of the attachable watercraft chair. In the illustrated embodiment, each suction cup 16 of the pair of suction cups comprises an extension arm 23. The extension arm 23 extends upward from each bracket 15 of the first pair of brackets and then outward, away from the back member 11. As such, each suction cup 16 is disposed away from the back member 11, to a sufficient extent that it can be more easily accessed by a user.

Additionally, in the illustrated embodiment, each suction cup 16 of the pair of suction cups is rotatably mounted upon the bracket 15. Specifically, in the illustrated embodiment, the extension arm 23 is secured to the bracket 15 via a pin 24 disposed through a pair of upward protrusions 25. As such, tension upon the extension arm 23 is reduced in circumstances where force is vertically exerted upon the extension arm 23. For example, as a watercraft floats, it is vertically displaced by action of waves in the water. This vertical displacement is accounted for via rotation of the extension arm 23.

Furthermore, in the illustrated embodiment, each suction cup 16 of the pair of suction cups is lever-actuated. Specifically, the suction cup 16 comprises a lever 26 in operable connection therewith. The lever 26 is operably affixed to the suction cup, such that when the lever 26 is engaged while the suction cup 16 is pressed against a surface, suction will be created via the lever 26. This force is released when the lever 26 is dis-engaged. As such, the user will have control over the actuation of the suction cup 16 in addition to the suction cup 16 being stronger and more stable.

In some embodiments, each bracket 15 of the first pair of brackets and the second pair of brackets is removable from the back member 11. In the illustrated embodiment, each bracket 15 is consisting of a first member 27 and a second member 28 affixed together via a fastener 29. The first member 27 and the second member 28 each comprise an arcuate cutout, such that a channel is formed therebetween. The channel is dimensioned and shape to receive the back member 11. The fastener 29 is of any suitable configuration and is configured to secure the first member 27 to the second member 28 at a desired tension level.

Figure 3:
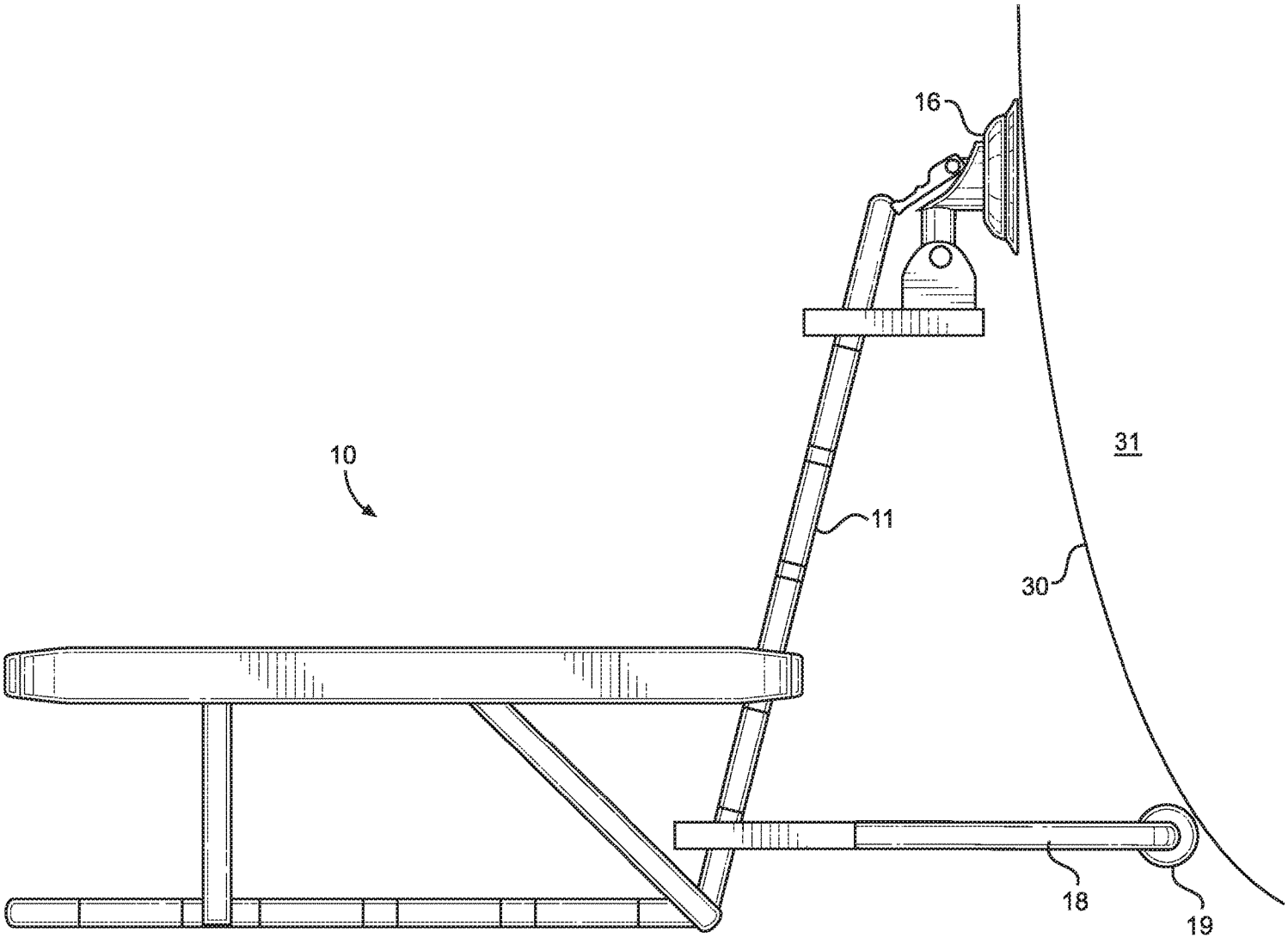
FIG. 3 shows a side view of an embodiment of the attachable watercraft chair in use.

Referring now to FIG. 3, there is shown a side view of an embodiment of the attachable watercraft chair in use. In use, the attachable watercraft chair 10 is engaged upon a side wall 30 of a watercraft 31. The suction cups 16 are placed against the side wall 30 of the watercraft 31, to attach the attachable watercraft chair 10 to the watercraft 31. When the suction cups 16 are engaged with the watercraft 31, the support bar 18 can then rest against the side wall 30 of the watercraft 31. As such, a user will be supported when sitting in the attachable watercraft chair 10.

In the illustrated embodiment, the support bar 18 extends outward from the back member 11 at a greater distance than the suction cups 16. As such, the attachable watercraft chair 10 can be placed on a watercraft with a sloping surface. In alternate embodiments, the positioning of the support bar 18 and the suction cups 16 is variable, depending on the specific watercraft upon which the attachable watercraft chair 10 is going to be attached.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An attachable watercraft chair, comprising:

a chair, comprising a back member pivotally attached to a seat member;

the back member defining a first end opposite of a second end;

the seat member pivotally attached at the second end of the back member;

a first pair of brackets disposed on the back member, proximal to the first end of the back member;

the first pair of brackets comprising a pair of suction cups thereon;

a second pair of brackets disposed on the back member, proximal to the second end of the back member;

the second pair of brackets comprising a support bar extending thereacross.

2. The attachable watercraft chair of claim 1, further comprising a pair of arm members rotatably engaged with the back member and the seat member.

3. The attachable watercraft chair of claim 1, wherein the pair of suction cups comprises an extension arm that extends upward from the bracket and away from the back member.

4. The attachable watercraft chair of claim 1, wherein the pair of suction cups are lever-actuated.

5. The attachable watercraft chair of claim 1, wherein the pair of suction cups are rotatably mounted upon the bracket.

6. The attachable watercraft chair of claim 1, wherein the first pair of brackets and the second pair of brackets are removable from the back member.

7. The attachable watercraft chair of claim 1, wherein the support bar comprises a U-shaped member extending outward from the back member.

8. The attachable watercraft chair of claim 1, wherein the support bar comprises a pad disposed thereon, opposite the back member.

9. The attachable watercraft chair of claim 1, wherein the support bar extends outward from the back member a greater distance than the pair of suction cups.

10. The attachable watercraft chair of claim 1, further comprising a webbing material disposed on the back member and the seat member.

11. An attachable watercraft chair, comprising:

a chair, comprising a back member pivotally attached to a seat member;

the back member defining a first end opposite of a second end;

the seat member pivotally attached at the second end of the back member;

a first pair of brackets disposed on the back member, proximal to the first end of the back member;

the first pair of brackets comprising a pair of suction cups thereon;

the pair of suction cups distally mounted on an extension arm that extends upward from the bracket and away from the back member;

wherein the pair of suction cups are lever-actuated;

a second pair of brackets disposed on the back member, proximal to the second end of the back member;

the second pair of brackets comprising a support bar extending thereacross;

the support bar having a pad mounted thereon.

12. The attachable watercraft chair of claim 11, further comprising a pair of arm members rotatably engaged with the back member and the seat member.

13. The attachable watercraft chair of claim 11, wherein the pair of suction cups are rotatably mounted upon the bracket.

14. The attachable watercraft chair of claim 11, wherein the first pair of brackets and second pair of brackets are removable from the back member.

15. The attachable watercraft chair of claim 11, wherein the support bar comprises a U-shaped member extending outward from the back member.

16. The attachable watercraft chair of claim 11, wherein the support bar extends outward from the back member a greater distance than the pair of suction cups.

17. The attachable watercraft chair of claim 11, further comprising a webbing material disposed on the back member and the seat member.

18. An attachable watercraft chair, comprising:

a chair, comprising a back member pivotally attached to a seat member;

the back member defining a first end opposite of a second end;

the seat member pivotally attached at the second end of the back member;

a pair of arm members rotatably engaged with the back member and the seat member;

wherein the pair of arm members are symmetrical to each other;

a first pair of brackets disposed on the back member, proximal to the first end of the back member;

the first pair of brackets comprising a pair of suction cups thereon;

the pair of suction cups distally mounted on an extension arm that extends upward from the bracket and away from the back member;

wherein the pair of suction cups are lever-actuated;

a second pair of brackets disposed on the back member, proximal to the second end of the back member;

wherein the second pair of brackets are disposed on a central point of the back member and the first pair of brackets are disposed closer to the first end of the back member than the second pair of brackets;

wherein the first pair of brackets and the second pair of brackets extend an identical distance from the back member;

the second pair of brackets comprising a support bar extending thereacross;

the support bar having a pad mounted thereon;

the support bar extending outward from the back member at a greater distance than the pair of suction cups.

* * * * *